US010285452B2

(12) United States Patent
Yarbrough

(10) Patent No.: US 10,285,452 B2
(45) Date of Patent: May 14, 2019

(54) SHIRT COLLAR STABILIZER

(76) Inventor: Leondre Yarbrough, Nashville, TN (US)

( * ) Notice: Subject to any disclaimer, the term of this patent is extended or adjusted under 35 U.S.C. 154(b) by 552 days.

(21) Appl. No.: 14/119,593

(22) PCT Filed: May 23, 2012

(86) PCT No.: PCT/US2012/039180

§ 371 (c)(1),
(2), (4) Date: Mar. 24, 2014

(87) PCT Pub. No.: WO2012/162414

PCT Pub. Date: Nov. 29, 2012

(65) Prior Publication Data

US 2015/0020290 A1 Jan. 22, 2015

Related U.S. Application Data

(60) Provisional application No. 61/489,143, filed on May 23, 2011.

(51) Int. Cl.
*A41B 3/00* (2006.01)
*A41B 3/06* (2006.01)

(52) U.S. Cl.
CPC . *A41B 3/06* (2013.01); *A41B 3/00* (2013.01)

(58) Field of Classification Search
CPC ... B65D 85/18; B65D 85/182; Y10T 24/1374; A41B 3/06; A41B 3/12; A41B 3/18; A41B 3/00; A41B 3/005; A41B 1/14
USPC ..... 223/66, 71, 84, 52.1, 89, 81, 83; 2/132, 2/255–264, 117, 323, 129, 134, 137, 142; 24/9, 3.4, 298, 7, 900.1
See application file for complete search history.

(56) References Cited

U.S. PATENT DOCUMENTS

| | | | | | |
|---|---|---|---|---|---|
| 892,604 | A * | 7/1908 | Meehan | A41B 3/06 | 2/132 |
| RE22,698 | E * | 11/1945 | Manaster | A41B 3/12 | 2/132 |
| 2,494,185 | A * | 1/1950 | Magney | A41B 3/06 | 2/132 |
| 2,820,269 | A * | 1/1958 | Wolff | A41B 13/10 | 2/52 |
| 5,414,903 | A * | 5/1995 | Porteous | A41B 13/10 | 2/49.1 |
| 6,494,573 | B1 * | 12/2002 | Huang | G02C 5/006 | 2/454 |

(Continued)

FOREIGN PATENT DOCUMENTS

| | | |
|---|---|---|
| DE | 841731 | 6/1952 |
| DE | 888982 | 9/1953 |
| JP | 2010203025 | 9/2010 |

OTHER PUBLICATIONS

International Search Report for PCT/US2012/039180 dated Dec. 20, 2012.

(Continued)

*Primary Examiner* — Nathan E Durham
*Assistant Examiner* — Abby M Spatz
(74) *Attorney, Agent, or Firm* — Fish & Richardson P.C.

(57) ABSTRACT

A shirt-collar stabilizer may include a collar stand surround, a first collar insert rotatably coupled to a first end of the collar stand surround, and a second collar insert rotatably coupled to a second end of the collar stand surround.

25 Claims, 13 Drawing Sheets

(56) References Cited

U.S. PATENT DOCUMENTS

| | | | | |
|---|---|---|---|---|
| 7,766,477 | B2 * | 8/2010 | Skuro | G02C 3/003 24/3.13 |
| 2008/0161023 | A1 * | 7/2008 | Ko | A44C 15/0015 455/462 |
| 2010/0313331 | A1 * | 12/2010 | English | A41B 3/06 2/132 |
| 2011/0113526 | A1 * | 5/2011 | Harris | A41B 3/06 2/132 |
| 2011/0289650 | A1 * | 12/2011 | Arrona | A41B 3/06 2/129 |
| 2012/0023640 | A1 * | 2/2012 | Gutierrez Garcia | A41B 3/06 2/116 |

OTHER PUBLICATIONS

International Preliminary Report on Patentability for PCT/US2012/039180 dated Nov. 26, 2013.

* cited by examiner

SHIRT COLLAR STABILIZER

CROSS REFERENCE TO RELATED APPLICATIONS

The present application is a U.S. National Stage of International Application Number PCT/US2012/039180, filed May 23, 2012, which claims priority to U.S. Provisional Application No. 61/489,143, filed May 23, 2011, entitled "SHIRT COLLAR STABILIZER," which applications are incorporated herein by reference in their entireties.

BACKGROUND

Shirt collars generally have a significant amount of flexibility, which may increase with time and wear. In view of this growing flexibility, it is common for the collar of a dress shirt to lie down and spread flat, particularly as the amount of wear the shirt experiences increases. Shirt collars may also experience other forms of disfigurement as wear increases. For example the tips of the collar of a shirt may begin curling upward or downward. Some wearers and shirt manufacturers employ the use of collar stays or collar tabs to rectify the curling of the tips of the shirt; however, such devices fail to address the spreading and flattening phenomenon and may contribute to it in some cases due to the weight of the tabs employed.

SUMMARY

The inventive embodiments disclosed herein relate generally to devices and methods for stabilizing the collar of a shirt. One inventive embodiment disclosed herein provides a shirt collar stabilizer that includes a collar stand surround, and first and second collar inserts rotatably coupled to ends of the collar stand surround. The collar stand surround may include a rod-shaped cross section and may include a metallic material, a non-metallic material, a composite material, or any combination of such materials. The collar stand surround may be at least partially composed of a malleable material, which material may include a malleable metal material. In accordance with various inventive embodiments, a rod-shaped collar stand surround may include a metallic substrate covered by a non-metallic layer. The collar stand surround may be a flat band, which may be a plastic material and may have a width between 1.5 mm and 50 mm. The collar inserts may include collar tabs, which may have a shape corresponding to a collar tab pocket on the collar of a shirt. In some inventive embodiments, rotatable couplings couple the first and second collar inserts to the collar stand surround. The rotatable coupling that couples the collar inserts to the collar stand surround in various inventive embodiments may include a ratchet, a ball and socket joint, a hinge, a flexure bearing, a twist lock connector, a screw joint, a sleeve coupling, a rotating bearing, a torsional spring, and a coiled spring. In some inventive embodiments, the collar stabilizer includes two rotatable couplings each rotatable coupling connecting each collar insert to the first and second ends of the collar stand surround, each rotatable coupling adapted to fix the respective insert to which the coupling is connected at a specific angle with respect to the collar stand surround. The collar inserts may be removably coupled to the collar stand surround. The collar stand surround may be composed of a moisture resistant material. In some inventive embodiments, the collar stabilizer includes a support band coupled to the collar stand surround and the collar stand surround may be composed of a plurality of connected members, which may be connected in a telescopic manner or in an extendable manner.

In some inventive embodiment, the collar stand surround includes a first channel formed at the first end of the collar stand surround and a second channel formed at the second end of the collar stand surround. The first insert may include a portion shaped to fit within the first channel, which portion may be positioned therein. The second insert may include a portion shaped to fit within the second channel, which portion may be positioned therein. Accordingly, each portion of each insert positioned within each channel may rotatably couple each insert to the collar stand surround. Each portion of each insert shaped to fit within each channel may include screw threads, and each channel may include grooves corresponding to the screw threads. In various embodiments, each insert may be a spring biased insert, whereby the insert exerts a force on an outer edge of the channel and wherein the outer edge of each channel biases each spring to a specific angular location with respect to the collar stand surround.

Various inventive embodiments provide a method of stabilizing a collar of a shirt. In accordance with such embodiments a shirt collar may be provided in an unfolded state, wherein the collar of the shirt extends upward from a collar stand of the shirt. The collar stand surround is positioned around and adjacent to the collar stand. A first collar insert may be inserted into a first pocket on a first side of the collar and a second collar insert may be inserted into a second pocket on the first side of the collar. After insertion of the first and second collar inserts into their respective pockets, the collar may be rotated downward with respect to the collar stand in concert with the first and second inserts.

BRIEF DESCRIPTION OF THE DRAWINGS

Certain features of a shirt collar stabilizer are described in detail herein below with reference to the figures. The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements.

Figure 1:
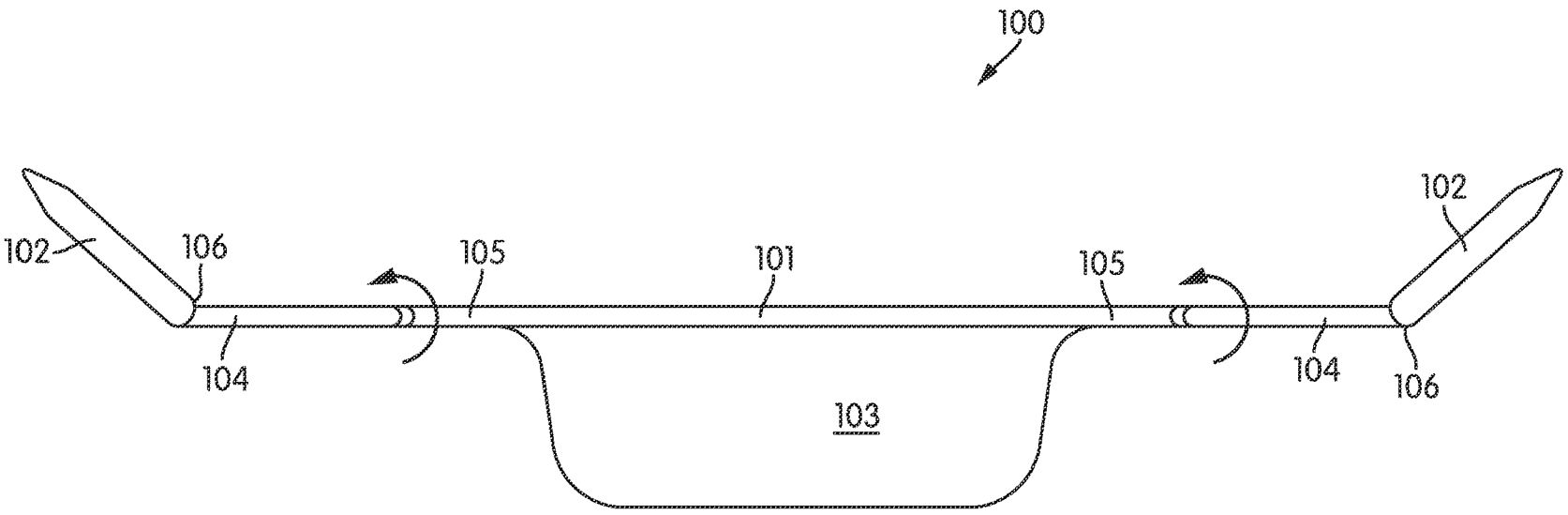
FIG. 1 provides a front view of a collar stabilizer, in accordance with one inventive embodiment.

The features and advantages of various inventive embodiments will become more apparent from the detailed description set forth below when taken in conjunction with the drawings.

DETAILED DESCRIPTION

Following below are more detailed descriptions of various concepts related to, and inventive embodiments of, apparatuses and methods for stabilizing a shirt collar. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Definitions. As used herein the following terms shall have the meanings indicated, unless indicated otherwise:

A "collar-stand surround" includes an elongated support structure having or malleable to have a curved portion or a portion configured to border a curved portion of a collar-stand. The curved portion of the elongated support structure allows the surround to substantially conform to the shape of a collar stand or a collar base, which stand or base supports the collar of a shirt worn by a person or the likeness thereof. A collar-stand surround may be composed of one or more connected members or segments, which members or segments may include linear members extending or connected to extend in a plurality of directions.

A "collar insert" includes a support structure insertable into a pocket formed on or within the collar of a shirt. A collar insert may include a portion geometrically shaped to correspond to a collar stay, tab, bone, knuckle, or stick. A collar stay, tab, bone, knuckle, or stick may have a pointed tip extending from a substantially rectangular shaped body.

A first component that is "rotatably coupled" to a second component is coupled to the second component in a manner whereby the first component may be positioned in a new orientation with respect to at least a portion of the second component while remaining coupled to the second component.

Referring now to the drawing figures, wherein like reference numerals identify similar, identical, or corresponding elements, embodiments of a shirt collar stabilizer and methods of using and producing the same are described.

FIG. 1 provides a front view of a collar stabilizer in accordance with various inventive embodiments. FIG. 1 depicts the collar stabilizer in a flattened or uncurled configuration. The central piece of the stabilizer is the collar stand surround 101, which in accordance with some embodiments may be provided in a plurality of distinct sections 105, and 106. Collar inserts 102 are rotatably coupled to the collar-stand surround 101 at the terminal sections or end sections 106 of collar stand surround 101. Accordingly, inserts 102 may be re-oriented via rotation with respect to at least a portion of surround 101. In accordance with various inventive embodiments, terminal sections 104 may rotate with respect to sections 101 and 105, contemporaneously with inserts 102 rotating with respect to sections 101 and 105. Accordingly, in such embodiments section 104 may be integral with insert 102. In accordance with other inventive embodiments, sections 104 may be integral with sections 105 and 101 and inserts 102 may rotate with respect to section 104; for example, by pivoting at the point of attachment 106 of inserts 102 with the end sections 104 of collar stand surround 101. FIG. 1 further demonstrates a support 103 for maintaining surround 101 in a particular position with respect to the collar. Specifically, support 103 may assist in maintaining surround 101 adjacent to an upper edge of a collar stand as will be described further herein.

Collar stand surround 101 may be composed of a variety of materials, in accordance with various inventive embodiments. The surround may also be provided in variety of structural configuration in accordance with various inventive embodiments. The surround may be composed out of a metallic material, a semi-metallic material, a non-metallic material, such as a composite, plastic, or polyurethane, or a combination of any of the aforementioned materials. In accordance with various inventive embodiments, the collar stand surround may be rigidly formed. In other inventive embodiments, the collar stand surround may be composed of a flexible material that is malleable into a desired configuration. The collar stand surround stabilizes the collar via its connection to the collar inserts, by maintaining the position of the inserts with respect to one another or the spacing there between and as will be discussed further herein, by controlling the angular position of each insert with respect the surround or the stand and hence the position of the collar.

In accordance with various inventive embodiments, the collar stand surround may have a rod-shaped configuration. For example, the collar stand surround may be composed of a malleable wire. In some embodiments, the collar stand surround may be produced in a particular geometric configuration, which facilitates the function of support 103, without the use of a distinct section. For example, inventive embodiments provide a collar stand surround in a band configuration.

Similar to the collar stand surround, the collar inserts may be provided in variety of materials and shapes in accordance with various inventive embodiments. In some embodiments, the collar stand surround may have a shape corresponding to a collar tab or collar stay, which may include a tapered end and may correspond to a pocket formed in the bottom side of a shirt collar. The collar insert may be a collar stay in various embodiments. The collar insert may be composed of a variety of materials, including metallic, non-metallic, and semi-metallic materials. The non-metallic materials that the inserts are composed of may be a variety of materials, which include synthetic materials, such as plastics or composites.

Figure 2:
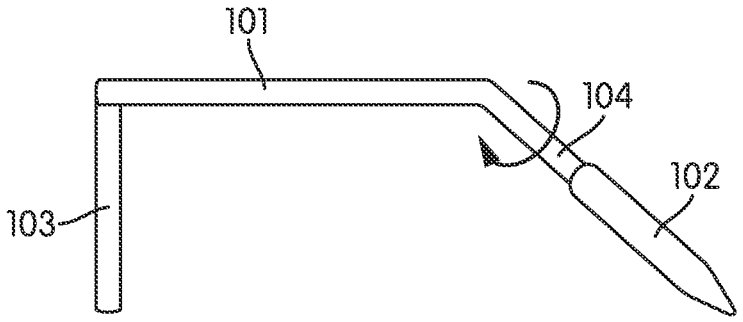
FIG. 2 provides a side view of a collar stabilizer of FIG. 1.

FIG. 2 provides a side view of a collar stabilizer in accordance with various inventive embodiments. As demonstrated in this side view, at least a portion of the collar stand surround may be angled downwardly, in accordance with various inventive embodiments. As further demonstrated in FIG. 2, support 103 may be substantially orthogonal to collar stand surround 101.

Figure 3:
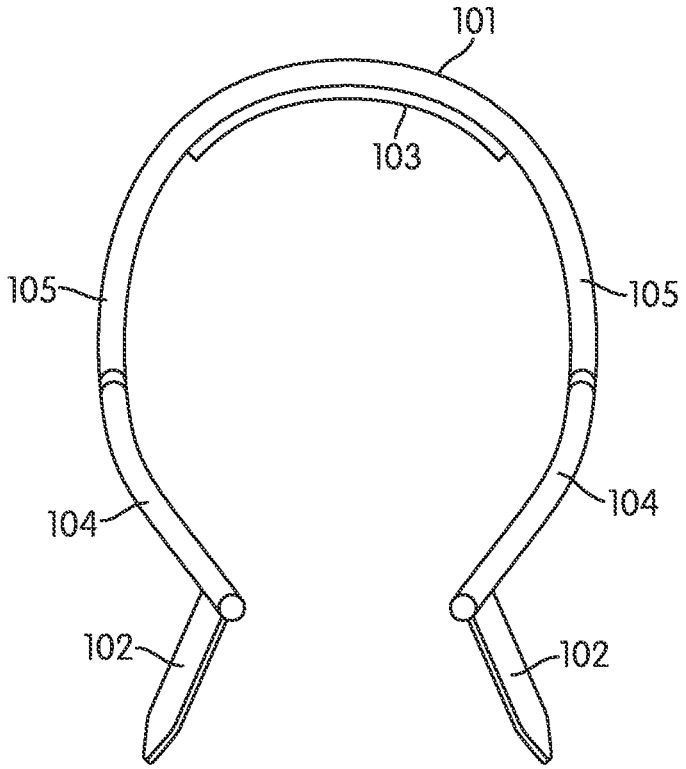
FIG. 3 provides a top view of a collar of FIG. 1.

FIG. 3 provides a top view of a collar stabilizer in accordance with various inventive embodiments. FIG. 3 demonstrates the curved configuration that collar stand surround 101 has or takes to stabilize a shirt collar.

Figure 4:
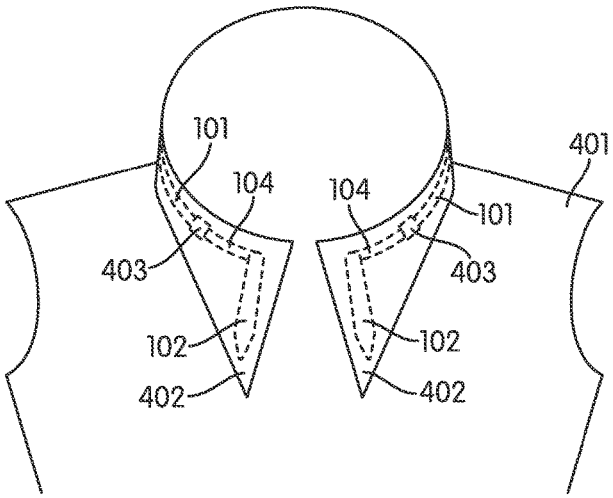
FIG. 4 provides a front view of a collar stabilizer engaged with a folded collar, in accordance with various inventive embodiments.

FIG. 4 provides a front view of a collar stabilizer engaged with a folded collar in accordance with various inventive embodiments. Shirt 401 includes a collar 402. The collar is in the folded down configuration in FIG. 4 and is translucently depicted so that the collar stabilizer, which is located beneath the folded down collar can be seen. The stabilizer depicted in FIG. 4 has its collar stand surround 101 connected to terminal portions of the collar stand surround via independent coupling mechanisms 403 in the embodiment shown. Coupling mechanisms 403 allow the terminal portions of the surround to be rotated with respect to the primary portion of the surround 101, which rotations are imparted into the collar inserts 102 to facilitate positioning the inserts into the collar when the collar is in an unfolded configuration as shown and described in reference to FIG. 5.

Figure 5:
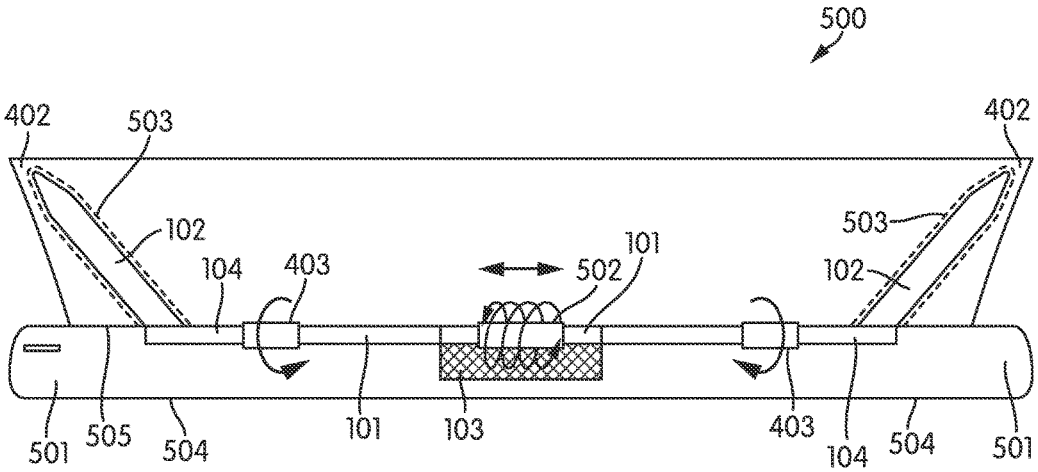
FIG. 5 provides a front view of a collar stabilizer engaged with an unfolded collar, in accordance with various inventive embodiments.
Figure 6:
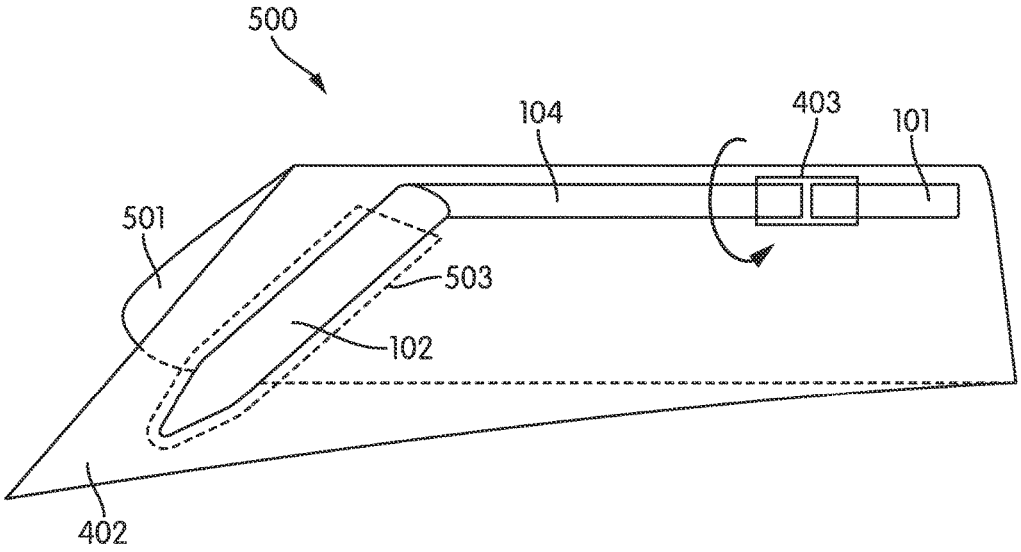
FIG. 6 illustrates a side view of a collar stabilizer engaged with a folded collar, in accordance with various inventive embodiments.

FIG. 5 provides a front view of a collar stabilizer engaged with an unfolded collar in accordance with an inventive embodiment. Collar 500 is depicted in an unfolded configuration, akin to the orientation that the collar may be provided in for engagement with a neck tie. Specifically, the upper portion 402 of collar 500 extends upward from the upper edge 505 of the collar stand 501. The bottom edge 504 of the collar stand attaches to the neck of a shirt (not shown in FIG. 5), such as the shirt 401 depicted in FIG. 4. Collar 500 is generally positioned in the depicted unfolded configuration for engagement with a collar stabilizer in accordance with various inventive embodiments. Once collar 500 is in the unfolded configuration, the collar stand surround is positioned adjacent to and around the collar stand 501 and the collar inserts 102 are inserted into the pockets 503 on the upper portion 402 of collar 500. Once the collar inserts 102 are inserted into pockets 503, the upper portion 402 of the collar can be folded down. The collar tabs 102 rotate downward with respect to the collar stand surround 101 contemporaneously with the upper portion 402 of collar 500 being folded down. Accordingly, as illustrated in FIG. 6, which shows a side view of a collar stabilizer engaged with a folded collar, the collar inserts point downward and the entire collar stabilizer is inconspicuously maintained under the upper portion 402 of the shirt collar 500, generally between upper portion 402 and collar stand 501.

FIG. 5 further demonstrates an extension mechanism 502, which may be incorporated into various embodiments of the collar stand surround in accordance with various inventive embodiments. The extension mechanism is connected to collar stand surround 101. The mechanism may be rotated, whereby it extends in length and thereby extending the overall useable length of collar stand surround 101. This extendibility facilitates use of a single device for various neck sizes. FIG. 5 also illustrates how support 103, which may have a height corresponding substantially to the height of collar stand, but generally slightly smaller so as not to be visible, may be positioned with respect to the collar stand to assist in maintaining collar stand surround 101 adjacent to the upper edge 505 of collar stand 501.

Figure 7:
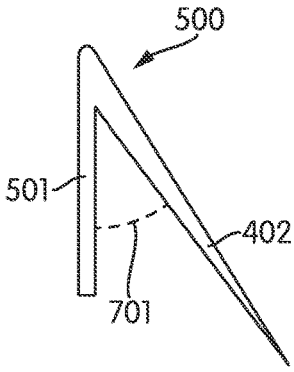
FIG. 7 illustrates a front view of a collar.

FIG. 7 illustrates a front view of a collar. As shown in FIG. 7, when the upper portion 402 of a shirt collar is folded down it may be positioned at a particular angle with respect to the collar stand surround. The desired angle may be facilitated and maintained by the rotation of the collar insert. In accordance with various inventive embodiments, the collar insert 102 may be rotated to a certain angle with respect to the collar stand surround 101, which angle may be maintained, for example by the rotatable coupling 403. The coupling may be rotated to a specific angle and fixed to that positioned by a biasing mechanism, by one or more notches, through the inclusion of a ratcheting mechanism, or by other structures. Additionally, the mechanism may simply have a particular resistance to rotation, which resistance may be calibrated to be at a threshold identified as limiting most inadvertent changes.

Figure 8:
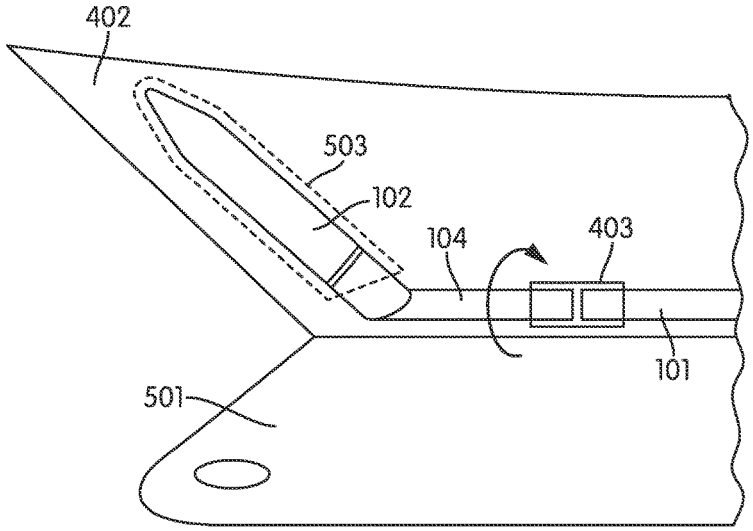
FIG. 8 shows a partial view of a collar stabilizer engaged with a unfolded collar, in accordance with various inventive embodiments.

FIG. 8 shows a magnified view of a collar stabilizer engaged with an unfolded collar as shown in FIG. 5. As demonstrated in FIG. 5 terminal section 104 couples insert 102 to the collar stand surround via coupling 403. Additionally, FIG. 5 further illustrates that in accordance with various embodiments the shape of the collar insert may substantially correspond to the shape of pocket 503 in the collar.

Figure 9:
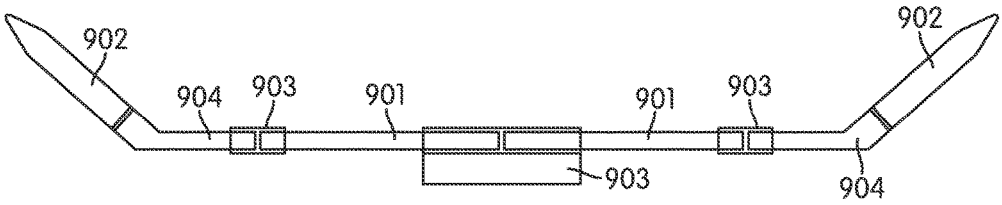
FIG. 9 provides a front view of a collar stabilizer, in accordance with various inventive embodiments.

FIG. 9 shows a front view of a collar stabilizer in accordance with various inventive embodiments. FIG. 9 depicts the collar stabilizer 900 in a flattened or uncurled configuration. Collar stabilizer 900 includes a multi-part collar stand surround 901 in accordance with various inventive embodiments. The respective portions of the collar stand surround 901 are connected via support 903 in the illustrated embodiment. Support 903 includes a channel within which each section 901 of the collar stand surround may be inserted. Accordingly, the support affords expansion and reduction of the overall length of the collar stand through sliding of sections 901 within support 903. When a section 901 of the collar stand surround is moved closer to the center of support 903, the collar stand surround will be shorter and when the section is moved closer to the end of the support from which it enters, the collar stand surround will be longer. In various embodiments, the support may include a locking mechanism for securing each section 901 in a fixed position. Additionally, each section 901 may include a flange at its terminal end and the support may include a flange at its terminal end to prevent the section from being completely withdrawn from support 903. Each section 901 is coupled via coupler 903 to terminal sections 904 of collar inserts 902. Accordingly, inserts 902 are rotatably coupled to the collar stand surround and may rotate with respect to sections 901 of collar stand surround.

Figure 10:
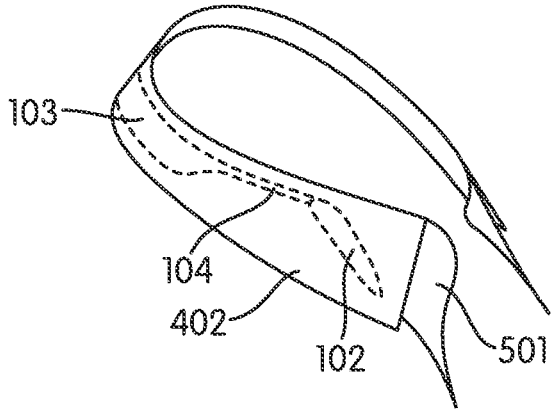
FIG. 10 provides a perspective view of a collar stabilizer engaged with a folded collar, in accordance with various inventive embodiments.

FIG. 10 provides a perspective view of a collar stabilizer engaged with a folded collar in accordance with various inventive embodiments.

Figure 11:
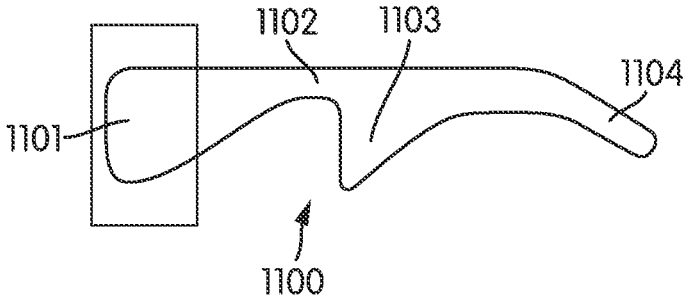
FIG. 11 illustrates a side view of a collar stabilizer, in accordance with various inventive embodiments.

FIG. 11 illustrates a side view of a collar stabilizer 1100 in accordance with an inventive embodiment. As shown in FIG. 11, the collar stand surround 1101 may integrally include a support structure to assist in maintaining the locale of the surround with respect to a shirt collar and collar stand. The surround may include a variety of geometries as demonstrated in FIG. 11, which may include narrowed regions 1102 and additional support regions 1103 having a greater width or height than regions 1102. Stabilizer 1100 includes collar inserts 1104, which may be rotatably coupled to the collar stand surround in accordance with various inventive embodiments.

Figure 12:
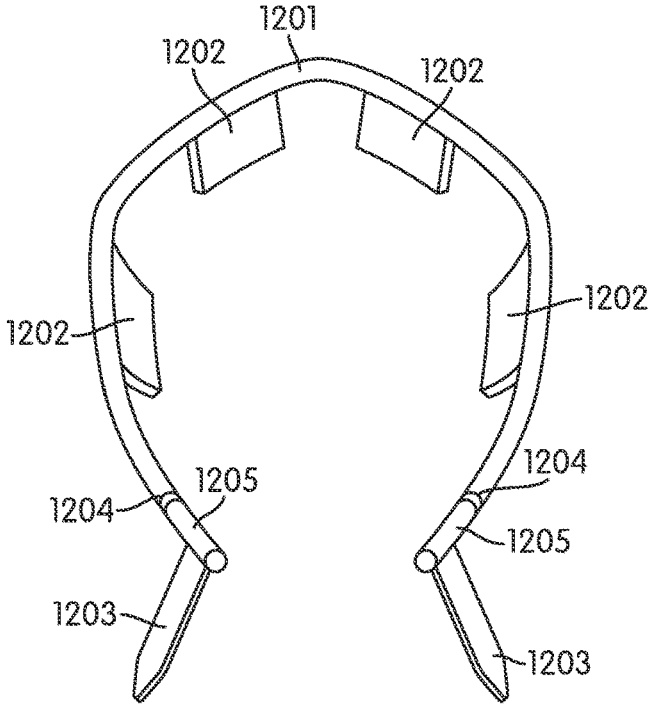
FIG. 12 illustrates a top view of a collar stabilizer, in accordance with various inventive embodiments.

FIG. 12 illustrates a top view of a collar stabilizer in accordance with another inventive embodiment. The embodiment demonstrated in FIG. 12 includes a plurality of support members 1202 coupled at various positions along the collar stand surround 1201. These support members may have different sizes in accordance with inventive embodiments, which sizes may be tailored to various collar styles. The support members may be composed of a variety of materials. The collar inserts 1203 are rotatably coupled to the collar stand surround via terminal sections 1205 and coupler 1204.

Figure 13:
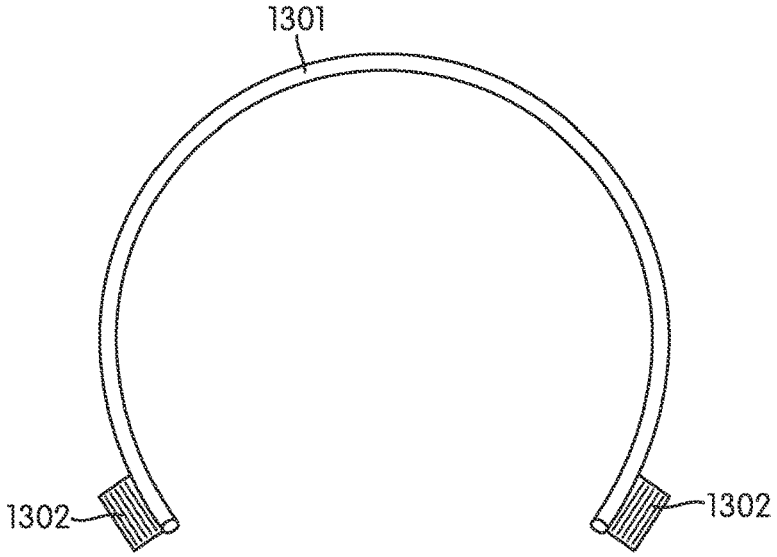
FIG. 13 shows a top view of a collar stabilizer, in accordance with various inventive embodiments.

FIG. 13 shows a top view of a collar stabilizer in accordance with various inventive embodiments. The embodiment demonstrated in FIG. 13 includes a collar stand surround 1301, which may be provided in one or more of the geometric configuration including, but not limited to, a flat band configuration and a rod-shaped configuration. Collar stand surround 1301 includes two landings 1302 positioned on each of its terminal ends. Landings 1302 may be wedged shaped (triangular prism) landings and may include a magnetic material for attracting collar tabs composed of ferromagnetic materials to the landings and thereby maintaining the collar that includes the ferromagnetic collar tabs positioned at least partially within the collar in a fixed position as further described with reference to FIG. 14. In accordance with other inventive embodiments, landings 1302 may be provided in other geometric shapes providing the desired collar angle with respect to the collar stand. Landings 1302 may be attached to surround 1301 in a fixed position in accordance with various inventive embodiments. In accordance with some inventive embodiments, landings 1302 may be removably coupled to surround 1301, such that landings with different geometric shapes or sizes may be attached. In accordance with some inventive embodiments, landings 1302 may be slidably attached to surround 1301 and surround 1301 may be extendable.

Figure 14:
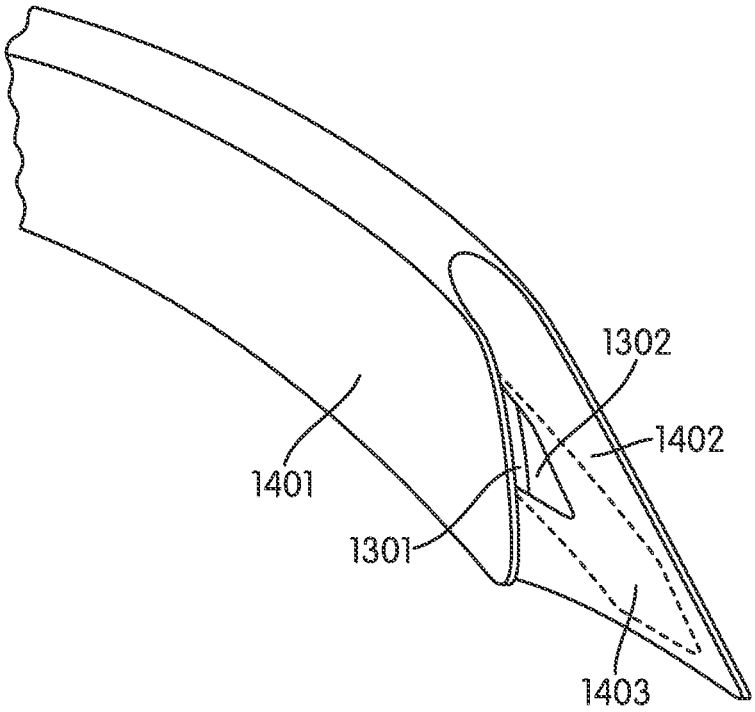
FIG. 14 shows a perspective view of the collar stabilizer of FIG. 13 positioned under a shirt collar.

FIG. 14 shows a perspective view of the collar stabilizer of FIG. 13 positioned under a shirt collar. As depicted and described in other embodiments including a collar stand surround, collar stand surround 1301 is positioned adjacent to the collar stand or collar base 1401. Surround 1301 may have a fixed curvature or may be malleable to have a curvature, thereby enabling it to maintain the shape and position of the collar stand surround. Collar stand surround 1301 may also include a distinct or separate support (not shown) similar to support 103 shown in FIGS. 1 and 5. Landings 1302 on the collar stand surround provide a support for the collar 1402. Additionally, landings 1302 may be composed of a magnetic material, whereby using collar tabs or stays 1403 composed of ferromagnetic materials, which tabs are disposed in a pocket on collar 1402, allows collar 1402 to be maintained in a fixed positioned with respect to landings 1302 and surround 1301 through the magnetic attraction between landings 1302 and stays 1403. In some embodiments, stays 1403 may be composed of magnetic materials and landings 1302 may be composed of ferromagnetic material. In yet other embodiments, both stays 1403 and landings 1302 may be composed of magnetic materials.

Figure 15:
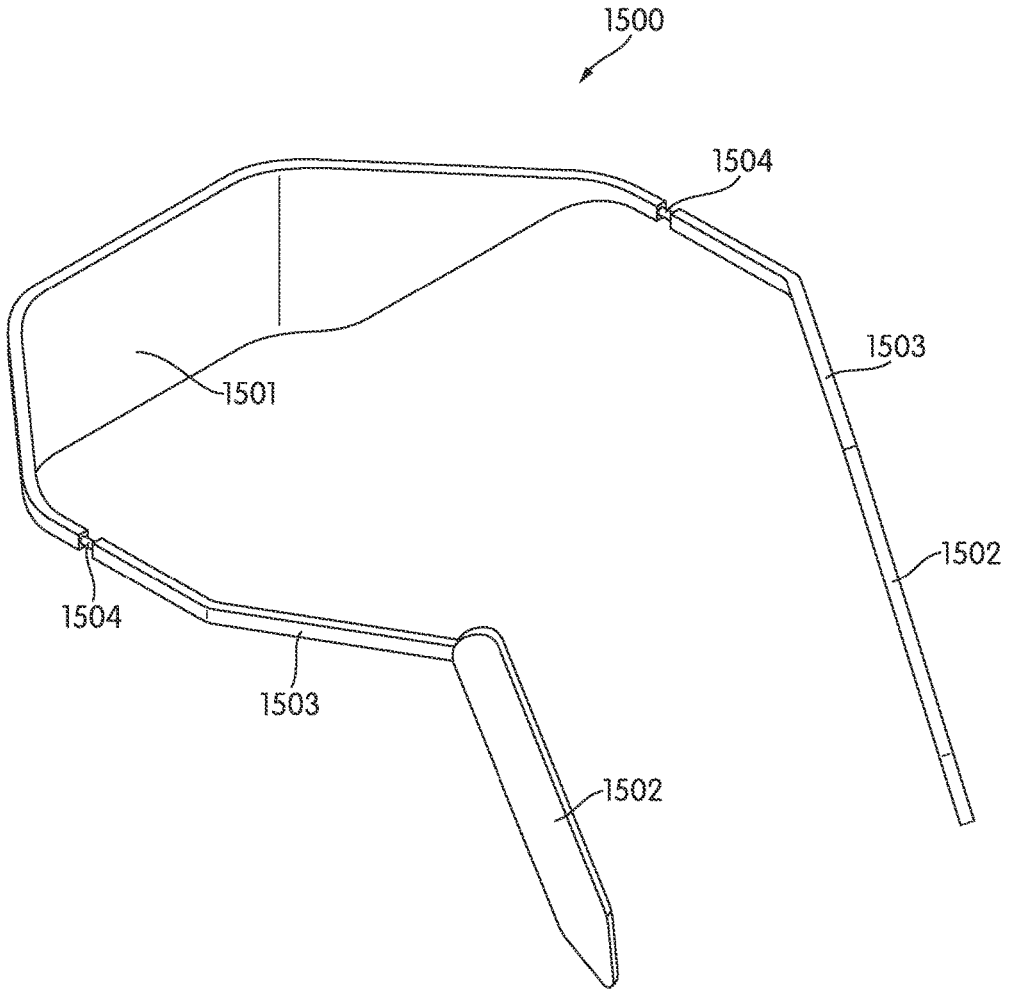
FIG. 15 shows a front perspective view of a collar stabilizer, in accordance with various inventive embodiments.
Figure 16:
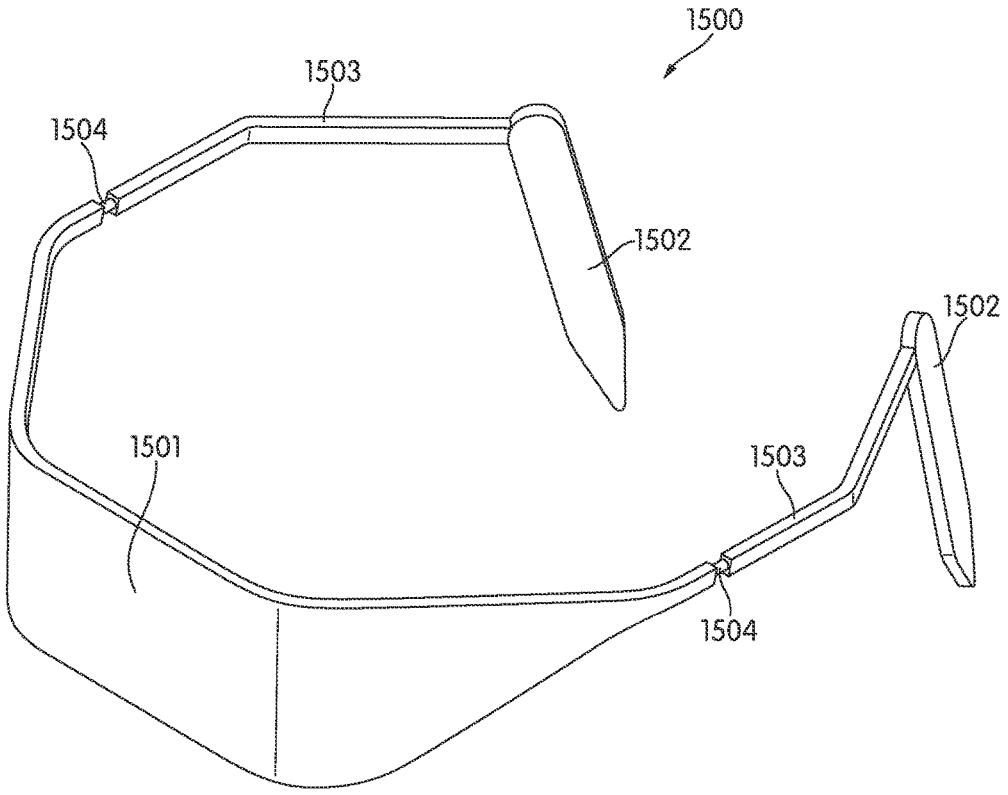
FIG. 16 shows a rear perspective view of the collar stabilizer of FIG. 15.

FIG. 15 shows a front perspective view of a collar stabilizer in accordance with exemplary inventive embodiments. FIG. 16 shows a rear perspective view of the collar stabilizer of FIG. 15. As demonstrated by FIGS. 15 and 16, collar stand surround 1501, may include a plurality of segments extending in different directions to border a curved shirt collar stand. Additionally, collar stand surround 1501 may extend in a direction having a vertical component, such that collar stand surround 1501 integrally includes a support. Collar inserts 1502 are rotatably coupled to collar stand surround 1501. As demonstrated by FIGS. 15 and 16, collar inserts 1502 may include an insert extension 1503, which insert may include a cylindrical post 1504. Collar stand surround 1501 may include a cylindrical opening shaped to correspond to post 1504 and configured to receive post 1504 for rotatably coupling collar insert 1502 to collar stand surround 1501. In some embodiments, surround 1501 and insert 1502 may include a gear and ratchet for rotatable coupling. In various inventive embodiments, a collar insert may be coupled to a collar stand surround via a flexure or another coupling configured to facilitate rotation between the collar inserts and the collar stand surround.

Figure 17:
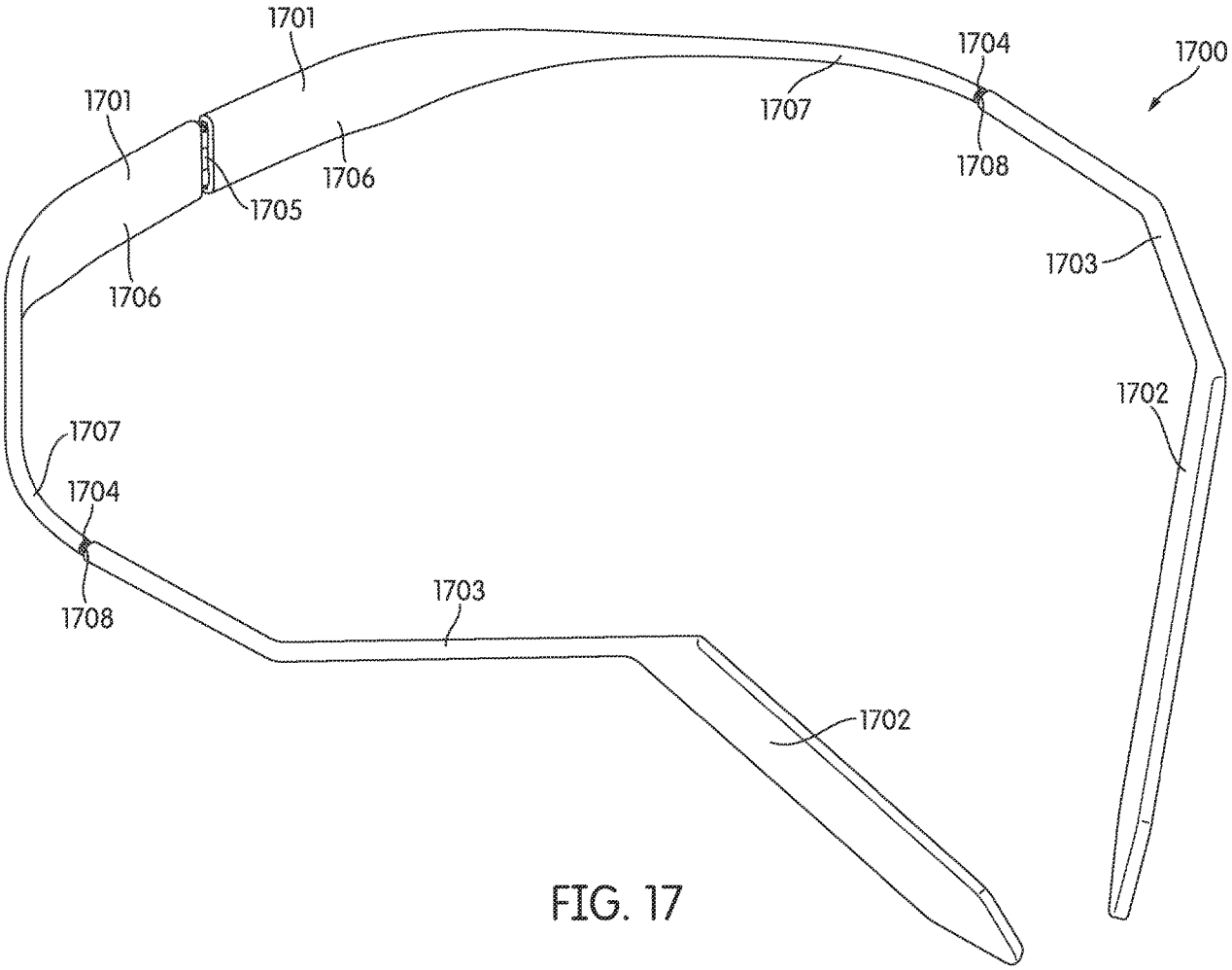
FIG. 17 shows a front perspective view of a collar stabilizer, in accordance with various inventive embodiments.
Figure 18:
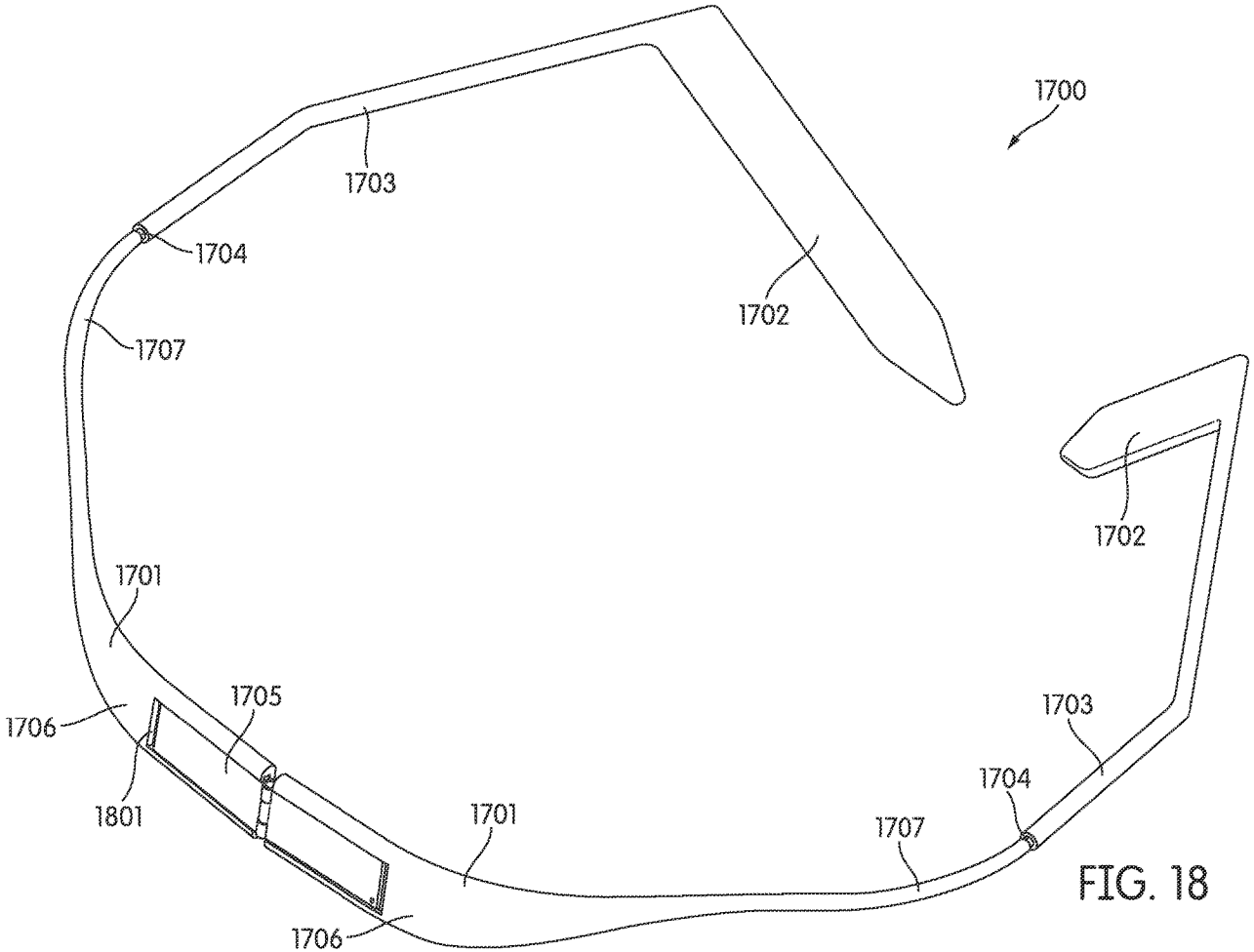
FIG. 18 shows a rear perspective view of the collar stabilizer of FIG. 17.

FIG. 17 shows a front perspective view of a collar stabilizer, in accordance with various inventive embodiments, and FIG. 18 provides a rear perspective view of the collar stabilizer of FIG. 17. Collar stabilizer 1700 of FIG. 17 includes a multi-component collar stand surround. The collar stand surround includes two segments 1701 coupled via a hinge 1705 configured to allow collar stabilizer 1700 to extend. As demonstrated in the illustrated embodiment, each section 1701 of the collar stand surround may include a base portion 1706 configured to provide collar stabilizer 1700 with support when placed adjacent to a collar stand of a shirt and when allowed to rest on the yoke of the shirt. Each base portion 1706 in the illustrated embodiments tapers into terminal sections 1707, which sections may include a rod like shape. In some embodiments, base sections 1706 may extend through the terminal sections of the collar stand surround and may not taper in contrast to the illustrated embodiment. Terminal sections 1701 of collar stand surround sections 1701 each include a socket 1708 configured to receive post 1704 extending from extensions 1703 of collar inserts 1702. Post 1704 is insertable into socket 1708 in terminal sections 1707 of collar stand surround 1701, such that collar insert 1702 is rotatably coupled to the collar stand surround. In another embodiment, post 1704 may be positioned on section 1707 of collar stand surround 1701 and socket 1708 may be positioned within section 1703 of the collar insert. In various embodiments, post 1704 and the corresponding socket in section 1707 may be configured such that collar inserts 1702 may be biased to remain in either an upward or downward position. Such biasing may be achieved via a spring component, a ratchet component, a flexure or various other components. Additionally, in various embodiments, section 1703 may be coupled to section 1707 via a hinge component. As exemplarily illustrated, collar inserts 1702 may be shaped to correspond to a pocket positioned on the underside of a collar configured to receive collar stays or collar tabs.

Figure 19:
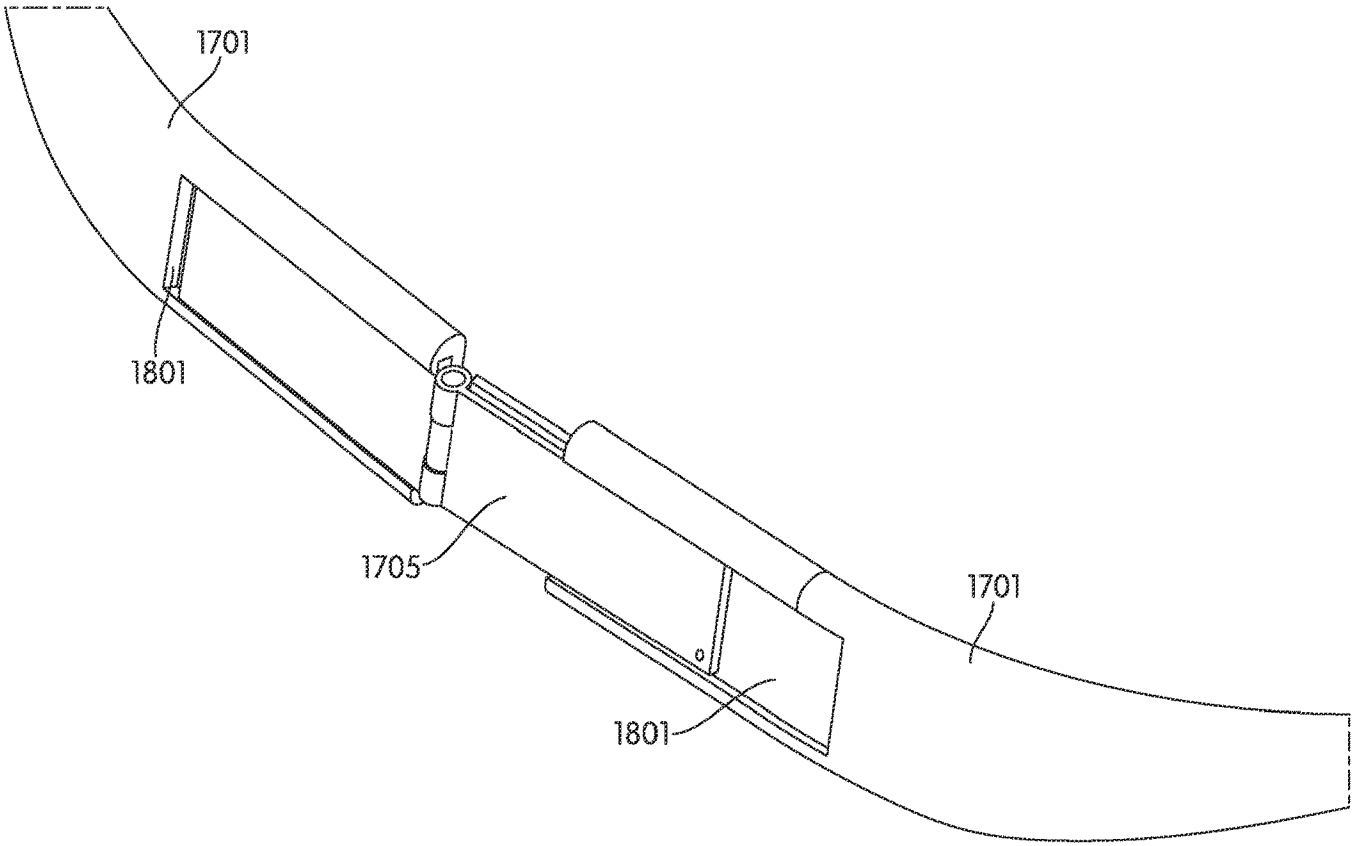
FIG. 19 shows a magnified view of a hinge provided with the embodiment of the collar stabilizer of FIG. 17.

FIG. 18 shows a rear perspective view of the collar stabilizer of FIG. 17, and FIG. 19 shows a magnified view of a hinge provided with the embodiment of the collar stabilizer of FIGS. 17 and 18. As shown in FIG. 18, collar stand surround sections 1701 may include a slot or channel 1801 configured to receive hinge 1705. Slot 1801 may be sandwiched within base 1706 of respective sections 1701 or may be open on a side, as shown in the illustrated embodiment. Slot 1801 permits collar stand 1701 and hinge 1705 to slide laterally with respect to one another and thereby permit the size of collar stabilizer 1700 to be increased or decreased as desired. Additionally, hinge 1705 may be rotatably opened or closed to provide further adjustability and thereby permit opposing collar inserts 1702 to be moved closed to one another or spread further apart to allow a user to tailor the position of collar stabilizer 1700, and thereby the collar of a shirt within which collar stabilizer 1700 is positioned, to their desired fit (e.g. further open or closed). Hinge, 1705 may also include a ratchet mechanism or may be configured for biasing at one or more positions, such that it may rotated to particular position and maintain that position in the absence of a substantial overcoming force or maneuver. Additionally, hinge 1705 and collar stand surround 1701 may include a pin and groove or other mechanism for fixing the hinge 1705 and surround 1701 at a position once adjusted. FIG. 19 provides a magnified view of hinge 1705 and further demonstrates lateral sliding of collar stand surround 1701 with respect to hinge 1705. Hinge 1705 may include a tab or other fastener for securing the hinge in one of a plurality of locations with respect to surround 1701 and slot 1801.

The above described inventive embodiments provide solely exemplary embodiments. Those of ordinary skill in the art will appreciate that the inventive embodiments include variations and modifications of the disclosed embodiments and may be captured by any claims provided herein or added hereto.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

I claim:

1. A shirt-collar stabilizer comprising:

a collar stand surround for positioning along a collar stand of a shirt-collar, the collar stand surround configured to extend in length so as to accommodate a plurality of shirt-collar neck sizes, the collar stand surround comprising:

a flat central section comprising a first end and a second end, a first terminal section rotatably coupled to the first end of the flat central section and configured to rotate coaxially with respect to the first end of the flat central section, the first terminal section configured to rotate coaxially with a resistance to rotation so as to maintain the shirt-collar, with respect to the collar stand, at a user-specified angle selected from a plurality of angles, and a second terminal section rotatably coupled to the second end of the flat central section and configured to rotate coaxially with respect to the second end of the flat central section, the second terminal section configured to rotate coaxially with a resistance to rotation so as to maintain the shirt-collar, with respect to the collar stand, at a user-specified angle selected from a plurality of angles;

a first collar insert coupled to the first terminal section of the collar stand surround, the first collar insert configured to rotate contemporaneously with the first terminal section of the collar stand surround when the first terminal section rotates coaxially with respect to the first end of the flat central section; and a second collar insert coupled to the second terminal section of the collar stand surround, the second collar insert configured to rotate contemporaneously with the second terminal section of the collar stand surround when the second terminal section rotates coaxially with respect to the second end of the flat central section, wherein the first terminal section includes a first cylindrical post configured to rotate coaxially with resistance in a first opening in the first end of the flat central section and wherein the second terminal section includes a second cylindrical post configured to rotate coaxially with resistance in a second opening in the second end of the flat central section, wherein the first cylindrical post and the second cylindrical post are round, and wherein the first cylindrical post and the second cylindrical post are unthreaded posts.

2. The shirt-collar stabilizer according to claim 1, wherein the collar stand surround is composed of a metallic material.

3. The shirt-collar stabilizer according to claim 1, wherein the collar stand surround includes a malleable material.

4. The shirt-collar stabilizer according to claim 1, wherein the collar stand surround includes a nonmetallic material.

5. The shirt-collar stabilizer according to claim 1, wherein the collar stand surround includes a composite material.

6. The shirt-collar stabilizer according to claim 1, wherein the collar stand surround includes a metallic substrate covered by a non-metallic layer.

7. The shirt-collar stabilizer according to claim 1, wherein the flat central section includes a plastic band.

8. The shirt-collar stabilizer according to claim 1, wherein at least a portion of the flat central section has a width between 1.5 mm and 50 mm.

9. The shirt-collar stabilizer according to claim 1, wherein the first and second collar inserts include collar tabs shaped to correspond to a collar tab pocket in the collar of a shirt.

10. The shirt-collar stabilizer according to claim 1, wherein the first terminal section and the second terminal section are rotatably coupled to the first end of the flat central section of the collar stand surround and the second end of the flat central section of the collar stand surround respectively and configured for coaxial rotation therewith by a rotatable coupling selected from the group consisting of: a ratchet, a ball and socket joint, a hinge, a flexure bearing, and a coiled spring.

11. The shirt-collar stabilizer according to claim 1, wherein each collar insert is removably coupled to the collar stand surround.

12. The shirt-collar stabilizer according to claim 1, wherein the collar stand surround includes a moisture resistant material.

13. The shirt-collar stabilizer according to claim 1, further comprising a support band coupled to the collar stand surround.

14. The shirt-collar stabilizer according to claim 1 wherein the collar stand surround includes a telescopic portion.

15. The shirt-collar stabilizer according to claim 1 wherein the collar stand surround is composed of a plurality of connected members.

16. The shirt-collar stabilizer according to claim 1, wherein the first end of the flat central section includes a first channel formed therein, wherein the second end of the flat central section includes a second channel formed therein, wherein the first terminal section includes a first cylindrical post portion shaped to fit within the first channel, and the second terminal section includes a second cylindrical post portion shaped to fit within the second channel, whereby the first cylindrical post rotates coaxially in the first channel contemporaneously with the first terminal section rotating coaxially with respect to the first end of the flat central section and the second cylindrical post rotates coaxially in the second channel contemporaneously with the second terminal section rotating coaxially with respect to the second end of the flat central section.

17. The shirt-collar stabilizer according to claim 16, wherein the first terminal section includes a first spring biased insert configured to bias the first terminal section to a first specific angular position along a first axis about which the first terminal section and the first end of the flat central section of the collar stand surround rotate about coaxially with respect to one another, and wherein the second terminal section includes a second spring biased insert configured to bias the second terminal section to a second specific angular position along a second axis about which the second terminal section and the second end of the flat central section of the collar stand surround rotate about coaxially with respect to one another.

18. The shirt-collar stabilizer according to claim 17, wherein the first spring biased insert and the second spring biased insert include respective torsional springs.

19. The shirt-collar stabilizer according to claim 1, wherein the first collar insert is coupled to the first terminal section at a first fixed angle and wherein the second collar insert is coupled to the second terminal section at a second fixed angle.

20. The shirt-collar stabilizer according to claim 1, wherein the first end and the second end of the flat central section are round.

21. The shirt-collar stabilizer according to claim 1, wherein the first terminal section is rotatably coupled to the first end of the flat central section of the collar stand surround by a first cylindrical support including a first channel configured to slidably receive the first end of the flat central section at a first end of the first cylindrical support, the first cylindrical support coupled to the first collar insert at a second end of the first cylindrical support that is opposite the first end of the first cylindrical support, the first cylindrical support positioned between the first end of the flat central section and the first collar insert, and wherein the second terminal section is rotatably coupled to the second end of the flat central section of the collar stand surround by a second cylindrical support including a second channel configured to slidably receive the second end of the flat central section at a first end of the second cylindrical support, the second cylindrical support coupled to the second collar insert at a second end of the second cylindrical support that is opposite the first end of the second cylindrical support, the first cylindrical support positioned between the second end of the flat central section and the second collar insert.

22. The shirt-collar stabilizer according to claim 21, wherein the first channel and the second channel are unthreaded.

23. The shirt-collar stabilizer comprising:

a collar stand surround for positioning along a collar stand of a shirt-collar, the collar stand surround configured to extend in length so as to accommodate a plurality of shirt-collar neck sizes, the collar stand surround comprising:

a flat central section comprising a first end and a second end, a first terminal section rotatably coupled to the first end of the flat central section and configured to rotate coaxially with respect to the first end of the flat central section, the first terminal section configured to rotate coaxially with a resistance to rotation so as to maintain the shirt-collar, with respect to the collar stand, at a user-specified angle selected from a plurality of angles, and a second terminal section rotatably coupled to the second end of the flat central section and configured to rotate coaxially with respect to the second end of the flat central section, the second terminal section configured to rotate coaxially with a resistance to rotation so as to maintain the shirt-collar, with respect to the collar stand, at a user-specified angle selected from a plurality of angles;

a first collar insert coupled to the first terminal section of the collar stand surround, the first collar insert configured to rotate contemporaneously with the first terminal section of the collar stand surround when the first terminal section rotates coaxially with respect to the first end of the flat central section;

a second collar insert coupled to the second terminal section of the collar stand surround, the second collar insert configured to rotate contemporaneously with the second terminal section of the collar stand surround when the second terminal section rotates coaxially with respect to the second end of the flat central section, wherein the first terminal section is rotatably coupled to the first end of the flat central section of the collar stand surround by a first cylindrical support including a first channel configured to slidably receive the first end of the flat central section at a first end of the first cylindrical support, the first cylindrical support coupled to the first collar insert at a second end of the first cylindrical support that is opposite the first end of the first cylindrical support, the first cylindrical support positioned between the first end of the flat central section and the first collar insert, and wherein the second terminal section is rotatably coupled to the second end of the flat central section of the collar stand surround by a second cylindrical support including a second channel configured to slidably receive the second end of the flat central section at a first end of the second cylindrical support, the second cylindrical support coupled to the second collar insert at a second end of the second cylindrical support that is opposite the first end of the second cylindrical support, the first cylindrical support positioned between the second end of the flat central section and the second collar insert.

24. The shirt-collar stabilizer according to claim 23, wherein the first channel and the second channel are unthreaded.

25. The shirt-collar stabilizer comprising:

a collar stand surround for positioning along a collar stand of a shirt-collar, the collar stand surround configured to extend in length so as to accommodate a plurality of shirt-collar neck sizes, the collar stand surround comprising:

a flat central section comprising a first end and a second end, a first terminal section rotatably coupled to the first end of the flat central section and configured to rotate coaxially with respect to the first end of the flat central section, the first terminal section configured to rotate coaxially with a resistance to rotation so as to maintain the shirt-collar, with respect to the collar stand, at a user-specified angle selected from a plurality of angles, and a second terminal section rotatably coupled to the second end of the flat central section and configured to rotate coaxially with respect to the second end of the flat central section, the second terminal section configured to rotate coaxially with a resistance to rotation so as to maintain the shirt-collar, with respect to the collar stand, at a user-specified angle selected from a plurality of angles;

a first collar insert coupled to the first terminal section of the collar stand surround, the first collar insert configured to rotate contemporaneously with the first terminal section of the collar stand surround when the first terminal section rotates coaxially with respect to the first end of the flat central section; and a second collar insert coupled to the second terminal section of the collar stand surround, the second collar insert configured to rotate contemporaneously with the second terminal section of the collar stand surround when the second terminal section rotates coaxially with respect to the second end of the flat central section, wherein the first terminal section and the second terminal section are rotatably coupled to the first end of the flat central section of the collar stand surround and the second end of the flat central section of the collar stand surround respectively and configured for coaxial rotation therewith by a rotatable coupling selected from the group consisting of: a ratchet, a ball and socket joint, a hinge, a flexure bearing, and a coiled spring.

* * * * *